US009820594B2

(12) United States Patent
Bower et al.

(10) Patent No.: US 9,820,594 B2
(45) Date of Patent: Nov. 21, 2017

(54) INSERT FOR A DRINKING CUP

(75) Inventors: Andrew C. Bower, Cambridge (GB); Anthony J. Mayne, Colchester (GB); Peter J. Smith, Amsterdam (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 345 days.

(21) Appl. No.: 13/143,734

(22) PCT Filed: Feb. 3, 2010

(86) PCT No.: PCT/IB2010/050467

§ 371 (c)(1),
(2), (4) Date: Jul. 8, 2011

(87) PCT Pub. No.: WO2010/092508

PCT Pub. Date: Aug. 19, 2010

(65) Prior Publication Data

US 2011/0278315 A1 Nov. 17, 2011

(30) Foreign Application Priority Data

Feb. 10, 2009 (EP) ..... 09152468

(51) Int. Cl.
*B65D 21/02* (2006.01)
*A47G 19/22* (2006.01)

(52) U.S. Cl.
CPC ..... *A47G 19/2272* (2013.01); *A47G 19/2261* (2013.01)

(58) Field of Classification Search
CPC ..... A47G 19/2272; A47G 19/2261; A47G 19/2266; A47G 19/2216; A47G 19/2211
USPC ..... 220/703, 719, 711, 713, 716, 714, 731, 220/734, 303, 367.1, 528, 796, 704, 220/717–718, 288; 215/386–387, 363; 229/906.1, 404; 222/546, 548
See application file for complete search history.

(56) References Cited

U.S. PATENT DOCUMENTS

| | | | | |
|---|---|---|---|---|
| 1,101,687 | A * | 6/1914 | Deeds | 215/363 |
| 1,254,251 | A | 1/1918 | Magnus | |
| 2,358,600 | A * | 9/1944 | Selten | 220/719 |
| 2,761,301 | A * | 9/1956 | Tellier | 220/719 |
| 2,857,068 | A * | 10/1958 | Kraepelin | 215/231 |
| 3,184,126 | A * | 5/1965 | Casull | 222/487 |
| 3,360,161 | A | 12/1967 | Smith | |
| 3,543,287 | A * | 11/1970 | Henry | 220/698 |
| 5,143,248 | A * | 9/1992 | Sawatsky | 220/711 |

(Continued)

FOREIGN PATENT DOCUMENTS

| | | |
|---|---|---|
| JP | 33004673 Y | 4/1956 |
| JP | 60096252 U1 | 12/1983 |

OTHER PUBLICATIONS

Eating & Drinking Assistance: http://www.able2.eu/catalogues/ADL/6-Eating-Drinking.pdf.

*Primary Examiner* — Anthony Stashick
*Assistant Examiner* — Robert Poon

(57) ABSTRACT

An insert to limit the rate of flow of liquid from a drinking cup includes a mount to locate the insert within a cup above a liquid contained therein but below a brim of the cup. A peripheral edge of the insert is spaced a predetermined distance from an inner surface of a cup such that, when a person drinks from the brim of a cup fitted with the insert, the rate of flow of liquid to the brim is limited by the insert.

17 Claims, 3 Drawing Sheets

(56) References Cited

U.S. PATENT DOCUMENTS

| | | | | | |
|---|---|---|---|---|---|
| 5,217,141 | A * | 6/1993 | Ross | A47G | 19/2261 220/713 |
| 5,372,275 | A * | 12/1994 | Yeh | | 220/713 |
| 5,477,979 | A * | 12/1995 | Goessling et al. | | 220/713 |
| 5,540,350 | A | 7/1996 | Lansky | | |
| 5,553,731 | A | 9/1996 | Schuyler | | |
| 6,199,711 | B1 | 3/2001 | Lansky | | |
| 8,127,965 | B1 * | 3/2012 | Miller | | 220/735 |
| 2005/0045647 | A1 | 3/2005 | Hession et al. | | |
| 2008/0017651 | A1 * | 1/2008 | Walker | B65D | 43/0208 220/711 |
| 2011/0049156 | A1 * | 3/2011 | Long, Jr. | | 220/326 |
| 2011/0084084 | A1 * | 4/2011 | Berg | | 220/703 |
| 2012/0080441 | A1 * | 4/2012 | Lin | | 220/810 |

* cited by examiner

INSERT FOR A DRINKING CUP

FIELD OF THE INVENTION

The present invention relates to an insert for a drinking cup. In particular, the present invention relates to insert to limit the rate of flow of liquid from a drinking cup. The present invention also relates to a drinking beaker comprising a drinking cup with an insert disposed therein.

BACKGROUND OF THE INVENTION

It is common for infants and toddlers to have difficulty during the transition from using baby bottles to consume liquid to using a conventional drinking cup. The resultant transitional and training phase often leads to the liquid in a cup being spilt. In general, sipper cups are used during a transitional phase to help train an infant to use a conventional drinking cup. Sipper cups utilise a lid with a spout or teat extending therefrom, through which an infant is able to consume a liquid at a controlled rate and with minimal spillages. However, the technique of drinking from a sipper cup is not analogous to drinking from a conventional cup and so such a device still does not train an infant to drink from a conventional open top cup. Therefore, there is a need to provide an additional transitional step between a sipper cup and a conventional cup.

Furthermore, children are also prone to try and impersonate adults in their behaviour and so there is a need to provide a drinking experience that is more analogous to that of drinking from a conventional open topped cup.

One known solution involves the use of a cup with a lid which incorporates a valve arrangement, which allows the flow of liquid therefrom when an infant is drinking from it, but prevents or limits spillage. However, such a known cup has a complicated mechanism and does not give the appearance of a conventional open-ended cup.

OBJECT OF THE INVENTION

Therefore, it is an object of the invention to provide an apparatus which substantially alleviates or overcomes the problems mentioned above and allows the consumption of a liquid from a cup or beaker in a way that is more analogous to drinking from a conventional open-topped cup.

SUMMARY OF THE INVENTION

Accordingly, the present invention provides an insert to limit the rate of flow of liquid from a drinking cup, the insert comprising mounting means to locate the insert within a cup above a liquid contained therein but below a brim of said cup so that a peripheral edge of the insert is spaced a predetermined distance from an inner surface of a cup such that, when a person drinks from the brim of a cup fitted with the insert, the rate of flow of liquid to the brim is limited by the insert.

Preferably, the peripheral edge extends circumferentially around the insert.

Advantageously, the peripheral edge is a first edge and the insert further comprises a second peripheral edge spaced from the first edge so that, when the insert is located in a cup in a first orientation, the first edge of the insert is spaced a first predetermined distance from an inner surface of a cup such that the rate of flow of liquid to the brim is a first flow rate and, when the insert is disposed in a cup in a second orientation, the second edge of the insert is spaced a second predetermined distance from an inner surface of a cup such that the rate of flow of liquid to the brim is a second flow rate.

In a preferred embodiment, a radius of the first edge is smaller than a radius of the second edge such that, when the insert is in its second orientation, the second predetermined distance from the second edge to an inner surface of a cup is smaller than the first predetermined distance from the first edge to an inner surface of a cup when the insert is in a first orientation.

The mounting means may comprise a plurality of protuberances extending from the insert which are mountable to an inner surface of a cup.

Preferably, the mounting means comprises two diametrically opposing protuberances which are configured to pivotable mount to an inner surface of a cup and define a rotational axis about which the insert is pivotable between its first and second orientations.

The insert may further comprise a locating portion extending from the insert which is configured to locate against a locating ridge formed on an inner surface of a cup to restrict rotation of the insert about its rotational axis when the insert is disposed in a cup.

Conveniently, the locating portion extends from one of the first or second edges.

Preferably, the insert further comprises a locating portion extending from the first edge to locate the insert in its first orientation when the insert is disposed in a corresponding cup and a locating portion extending from the second edge to locate the insert in its second orientation when the insert is disposed in a cup.

In one embodiment, the insert further comprises two diametrically opposing locating portions extending from the first edge and two diametrically opposing locating portions extending from the second edge.

The insert may further comprise two opposing faces from which the first and second edges extend and a drainage hole formed through the insert which extends between said opposing faces.

According to another aspect of the invention, there is provided a drinking beaker comprising a drinking cup and an insert, the insert being disposed within the cup above a liquid contained therein but below a brim of said cup.

Preferably, the cup comprises a circumferentially extending recess which is configured to receive the mounting means to mount the insert in the cup.

Conveniently, the cup further comprises a circumferentially extending locating ridge against which the locating portion of the insert is locatable to restrict rotation of the insert about its rotational axis in the cup.

Advantageously, the insert is removable from the cup.

Preferred embodiments of the invention will now be described, by way of example only, with reference to the accompanying drawings, in which.

Figure 1:
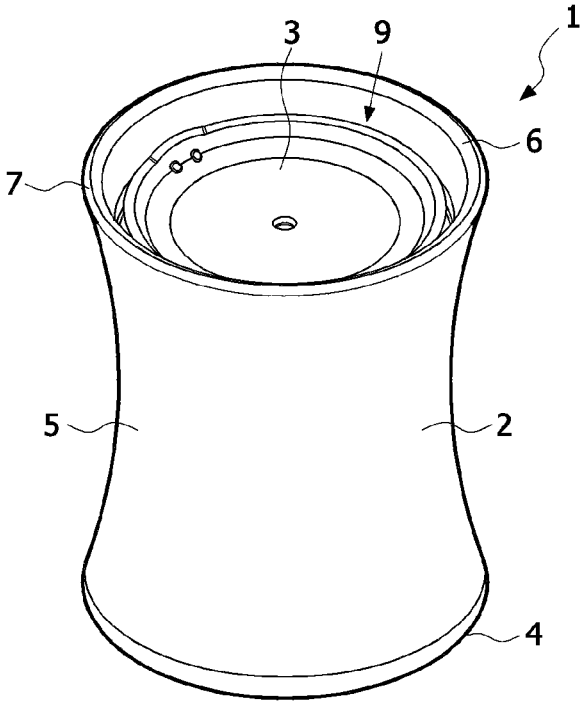
FIG. 1 illustrates a perspective view of a drinking beaker with an insert disposed in a cup.
Figure 2:
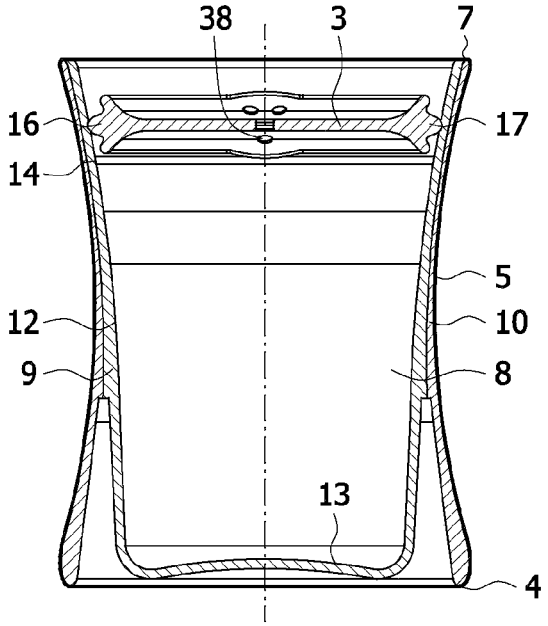
FIG. 2 illustrates a cross sectional view of the drinking beaker shown in FIG. 1, with the insert shown disposed in the cup.
Figure 3:
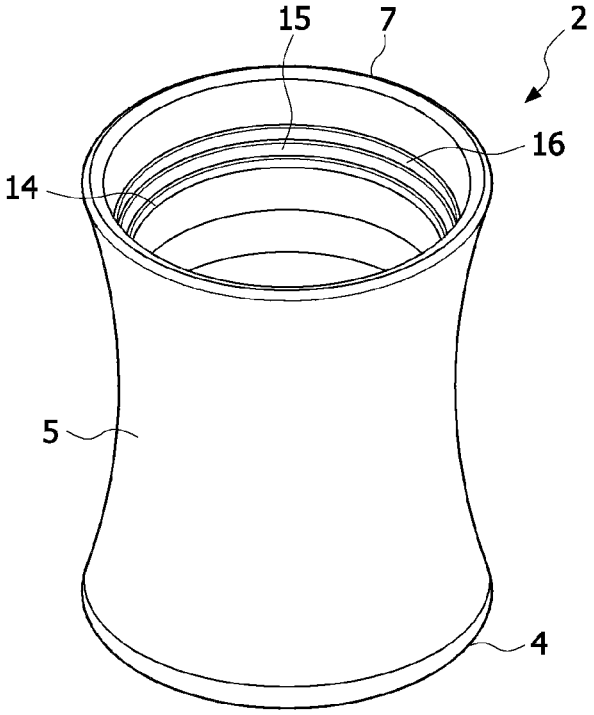
FIG. 3 illustrates a perspective view of the cup shown in FIG. 1.
Figure 4:
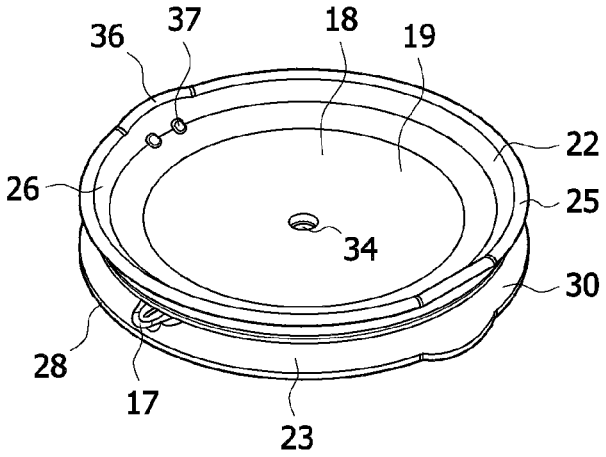
FIG. 4 illustrates a perspective view of the insert shown in FIG. 1.
Figure 5:
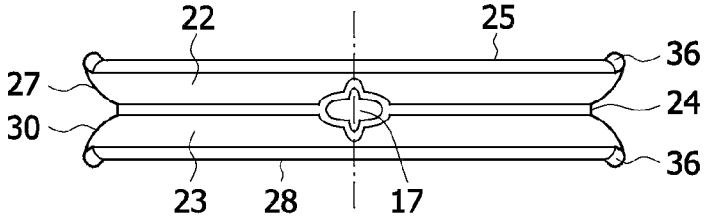
FIG. 5 illustrates a side view of the insert shown in FIG. 4.
Figure 6:
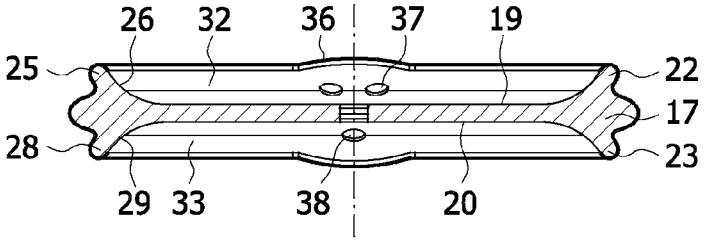
FIG. 6 illustrates a cross-sectional side view of the insert shown in FIG. 4.
Figure 7:
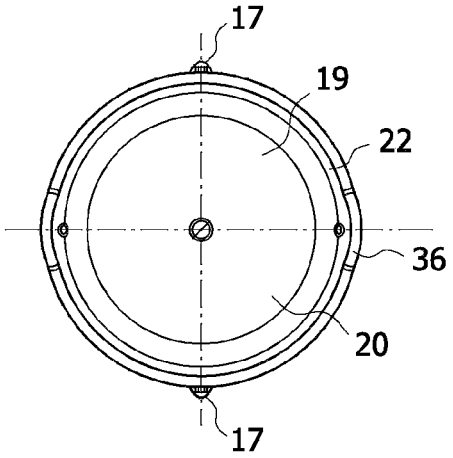
FIG. 7 illustrates a plan view of the insert shown in FIG. 4.

Referring now to the drawings, FIGS. 1 and 2 illustrates a drinking beaker 1 comprising a drinking cup 2 and an insert 3 disposed in the cup 2. The cup 2 has a base 4, an outer surface 5 and an open upper end 6. The outer surface 5 of the cup 2 is concave, such that the cup has a narrower diameter in a middle region between upper and lower ends of the cup 2. The shape of the cup 2 allows an infant to attain an adequate grip on the cup so as to minimise dropping thereof. The open upper end 6 of the cup 2 has a circular brim 7 extending therearound which defines the opening to a cavity 8 of the cup 2 in which a liquid is contained during use of the beaker 1.

The cup 2 comprises an inner shell 9 and an outer shell 10. The outer shell 10 defines the outer surface 5 of the cup 2 and extends outwardly at the cup's base 4 to form a stable platform, such that the beaker 1 can be stably located on a flat surface such as a table (not shown). The inner shell 9 is integrally formed with the outer shell 10 and has an inner surface 12 and a base surface 13 which define the cavity 8 for receiving liquid therein. The base 4 of the outer shell 10 of the cup 2 extends below the inner shell 10, such that the inner shell 10 does not contact a surface (not shown), such as a table, when placed thereon.

The cup 2 is formed from a moulded plastic material, although it will be understood that the cup 2 may be formed from any suitable non-toxic material. The cup 2 is formed to hold both hot and cold liquids therein. The inner surface 12 of the cup 2 defined by the inner shell 9 converges from the brim 7 to the inner shell's lower end, to aid the consumption of liquid therefrom and to enable the insert 3 to be inserted and removed therefrom at the broader open end, as will be explained in detail hereinafter.

A circumferentially extending ledge 14 is formed in the inner surface 12 of the cup 2 proximate to, but spaced from, the brim 7 of the cup 2. The ledge 14 extends inwardly from an upper portion of the inner surface 12 and is inclined downwardly so that a face of the ledge 14 forms an obtuse angle with a face 15 of said upper portion.

A circumferentially extending recess 16 is formed extending around the inner surface of the cup 2, and is formed in the inner surface 12 between the brim 7 of the cup 2 and the circumferentially extending ledge 14. The recess 16 has an arcuately shaped surface which extends circumferentially around the inner surface 12 of the cup 2 and is arranged to receive remote ends of mounting protuberances 17 extending from the insert 3 such that they locate therein, as will be explained in detail hereinafter.

The insert 3 is seated in the upper end of the cavity 8 of the cup 2, below the brim 7 thereof, but above a liquid contained in the cup 2 when the cup is used. The insert 3 is shown in FIGS. 4 to 7 and comprises a circular plate 18 with opposing first and second faces 19,20. A first extended rim 22 upstands from a periphery of the first face 19 of the circular plate 18 and extends circumferentially therearound and a second extended rim 23 upstands from a periphery of the second face 20 of the circular plate 18. Each of the first and second extended rims 22,23 extend outwardly from the circular plate 18 and are spaced from each other to define a circumferentially extending recess 24 extending therearound.

A remote peripheral edge of the first extended rim 22 distal to the first face 19 defines a first peripheral edge 25 of the insert 3 and extends circumferentially therearound. The first peripheral edge 25 is rounded to promote comfort and prevent any injury as a result of use of the insert 3. Inner and outer surfaces 26,27 of the first extended rim 22 extend from the circular plate 18 and converge to the first peripheral edge 25.

A remote peripheral edge of the second extended rim 23 distal to the second face 20 defines a second peripheral edge 28 of the insert 3 and extends circumferentially therearound. The second peripheral edge 28 is rounded to promote comfort and prevent any injury as a result of use of the insert 3. Inner and outer surfaces 29,30 of the second extended rim 23 extend from the circular plate 18 and converge to the second peripheral edge 28.

The radius of the first peripheral edge 25 is smaller than the radius of the second peripheral edge 28, for reasons that will be explained hereinafter.

The inner surfaces 26,29 of the first and second extended rims 23 define first and second hollows 32,33 of the insert 3 respectively. A drainage hole 34 is formed through the main body 18 between the first face 19 of the circular plate 18 and the second face 20 of the circular plate 18 such that liquid collecting in the uppermost hollow of the first or second hollows 32,33 during use of the insert 3, as will be explained below, can drain through the drainage hole 34 into the cavity 8 of the cup 2 for receiving liquid therein.

Two mounting protuberances 17 extend from the insert 3 diametrically opposite each other. Each mounting protuberance 17 is formed to extend from the circumferentially extending recess 24 between the first and second extended rims 22,23 and a remote end of each mounting protuberance 17 extends beyond the radial edge of both the first and second peripheral edges 25,28 so that each mounting protuberance 17 defines a predetermined distance from an inner surface of the cup 2 to one of the first and second peripheral edges 25,28 when the insert 3 is disposed in the cup 2, as will be explained in detail hereinafter. The remote end of each mounting protuberance 17 is rounded so that each remote end is rotatable in the circumferentially extending recess 16 formed extending around the inner surface of the cup 2.

Locating portions 36 extend from the first and second peripheral edges 25,28 of the first and second extended rims 22,23. The first peripheral edge 25 includes two curved diametrically opposing locating portions 36 which upstand and extend outwardly from said edge 25. Similarly, the second peripheral edge 28 includes two curved diametrically opposing locating portions 36 which upstand and extend outwardly from said edge 28.

A pair of nubs 37 is formed on the inner surface 26 of the first extended rim 22 and a single nub 38 is formed on the inner surface 29 of the second extended rim 23. The nubs 37,38 indicate the orientation of the insert 3 in the cup 2 during use so as to indicate the achievable flow rate of liquid from the cavity 8 of the cup 2 during use, as will become apparent hereinafter.

Use of the insert 3 according to the above exemplary embodiment in a cup 2 will now be described with reference to the FIGS.

A user pours a liquid into the cavity 8 formed in the cup 2 and the insert 3 is inserted into the cup 2. The remote ends of the diametrically opposed protuberances 17 are clipped into the circumferentially extending recess 16 formed in the inner surface 12 of the cup 2. The insert 3 can be inserted in any orientation due to the circumferentially extending recess 16 extending around the inner surface 12. When the protuberances 17 are disposed in the recess 16, the insert can rotate about the axis defined by the protuberances 17 in the cup. Another advantage of this arrangement is that the insert is removable from the cup, which allows the cup and the insert to both be easily cleaned and sterilised, if necessary.

The insert 3 is mountable in the cavity 8 of the cup 2 because the cup diverges outwardly at its upper end, but is restricted from being inserted too far into the cavity 8. The insert 3 is formed from a moulded plastic material, although it will be understood that the insert 3 may be formed from any suitable non-toxic material.

The insert 3 is restricted from freely rotating by the locating portions 36. The locating portions 36 locate against the circumferentially extending ledge 14 formed on the inner surface 12 of the cup 2 as the insert 3 is rotated. The insert 3 is fixedly locatable in two orientations; a first orientation wherein the second face 20 of the insert 3 is uppermost facing out of the cavity 8 of the cup and the first peripheral edge 25 faces into the cavity 8, and a second orientation wherein the first face 19 of the insert 3 is uppermost facing out of the cavity 8 of the cup 2 and the second peripheral edge 28 faces into the cavity 8.

In the first orientation, the first edge 25 is proximal to the inner surface 12 of the cup 2 and is spaced a first predetermined distance therefrom. The locating portions 36 extending from the first edge 25 are located against the circumferentially extending ledge 14, and so the insert is immovably mounted in the cup 2 below the brim 6.

If an infant holds the cup and tilts it towards their mouth, then the liquid flows towards the brim 6 of the cup 2. The insert 3 is disposed in the cavity 8 of the cup above the liquid in the cavity and so the flow of liquid from the cup 2 is limited by the insert due to the small gap between the first peripheral edge 25 of the insert 3 and the adjacent inner surface 12 of the cup 2.

Due to the contour of the cup, in particular the inner surface diverging outwardly towards the brim 6, the distance between the inner surface 12 of the cup and the second edge 28 is much greater than the distance between the inner surface 12 and the first edge 25, when the insert is in its first orientation in the cup and so the flow rate is defined by the predetermined distance between the inner surface 12 of the cup and the first edge 25. The distance between the first edge 25 and the inner surface 12 is uniform circumferentially around the insert 2 due to the corresponding shapes of the inner surface 12 of the cup 2 and the first peripheral edge 25 of the insert 3 and so the flow rate is limited to a consistent flow rate, regardless of the position on the brim 6 from which an infant drinks.

In the first orientation of the insert 3 when the insert 3 is located in the cup 2, the flow of liquid from the cup 2 is limited to a first flow rate. A user can then alter the flow rate by pushing on a peripheral part of the uppermost of the first and second surfaces 19,20 of the insert, distal to the mounting protuberances 17, in order to rotate the insert in the cup 2.

The locating portions 36 click over the circumferentially extending ledge 14 due to the resilience of the insert 3 and/or the cup 2 and the insert 3 is then free to rotate about the axis defined by the diametrically opposing protuberances 17, from the first orientation to the second orientation, wherein the second surface 20 is uppermost and the second peripheral edge 28 faces into the cavity 8. The locating portions 36 extending from the second edge 28 resiliently deform over the ledge 14 and locate thereon to restrict rotation of the insert 3, such that the insert 3 is immovably located in its second orientation.

If an infant holds the cup and tilts it towards their mouth, then the liquid flows towards the brim 6 of the cup 2. The insert 3 is disposed in the cavity 8 of the cup above the liquid in the cavity 8 in the second orientation and so the flow of liquid from the cup 2 is limited by the insert due to the small gap between the second peripheral edge 28 of the insert 3 and the adjacent inner surface 12 of the cup 2.

Due to the contour of the cup, in particular the inner surface diverging outwardly towards the brim 6, the distance between the inner surface 12 of the cup and the first edge 25 is much greater than the distance between the inner surface 12 and the second edge 28 when the insert is in its first orientation in the cup 2 and so the flow rate is defined by the predetermined distance between the inner surface 12 of the cup and the second edge 28. The distance between the second edge 28 and the inner surface 12 is uniform circumferentially around the insert 2 due to the corresponding shapes of the inner surface 12 of the cup 2 and the second peripheral edge 28 of the insert 3 and so the flow rate is limited to a consistent flow rate, regardless of the position on the brim 6 from which an infant drinks.

In the second orientation of the insert 3 when the insert 3 is located in the cup 2, the flow of liquid from the cup 2 is limited to a second flow rate.

During consumption of the liquid from the cup 2, any liquid that is spilt into either the first or second hollow 32,33 of the insert 3 is free to drain back into the cavity 8 through the drainage hole 34. Furthermore, if the cup is knocked over, then the flow of liquid from the cavity 8 is limited by the insert when the insert is in place and so the extent of the spillage is limited.

The desired flow rate, either the first or second flow rate is determined by orientating the insert 3 in its first or second orientation in the cup 2. The orientation of the cup is indicated by the nubs 37, 38 on the inner surfaces 26,29 visible depending on the orientation of the insert 3.

Therefore, three flow rates of liquid from the cavity 8 of the cup 2 are achievable. A first flow rate, wherein the insert is disposed in the cup 2 in a first orientation with the first peripheral edge lowermost, a second flow rate, wherein the insert is disposed in the second orientation with the second peripheral edge lowermost and a third flow rate, wherein the insert is removed from the cup and the cup is usable as a conventional drinking beaker.

Although in the above embodiment, the radius of the first peripheral edge 25 is smaller than the radius of the second peripheral edge 28 so that the predetermined distance between the first edge 25 of the insert 3 and the inner surface 12 of the cup is greater in a first orientation than in a second orientation, it will be understood that the invention is not limited thereto and the predetermined distance between the inner surface 12 and the relevant peripheral edge 25,28 can be varied in an alternative manner. For example, in an alternative embodiment the depth of the first and second extended rims 22,23 may differ such that distance between the circular plate 18 and each of the first and second peripheral edges 25,28 differ and so the distance between each of the first and second peripheral edges 25,28 and the inner surface 12 in the first and second orientations are different due to the slope of the inner surface 12.

An advantage of the above arrangement is that the insert can be removed so that an infant can drink from the cup in the manner of a normal drinking beaker. Furthermore, an infant can drink from anywhere around the rim of the cup 2, regardless of whether the insert is disposed in the cup 2, because the insert is located in the cup below the brim 7 of the cup, but above a liquid contained in the cup.

Although the mounting means for locating the insert in the cup comprises two diametrically opposing protuberances in the above embodiment, it will be appreciated that the invention is not limited thereto and that the mounting means may be any means to allow a peripheral edge of the insert to be spaced a predetermined distance from the inner surface of the cup.

Although the above embodiments are described with the insert 3 having first and second peripheral edges 25,28 extending therearound to define the predetermined distance between the insert 3 and the inner surface 12 of the cup 2 dependent on the orientation of the insert in the cup 2, it will be appreciated that in an alternative embodiment, the insert 3 comprises a single rim and peripheral that is insertable in a cup to limit the flow of liquid therefrom. In this embodiment, the insert is rotatable to aid pouring liquid into the cup 2 without removing the insert therefrom. Alternatively, the mounting means may comprise a plurality of protuberances to immovably locate the insert 3 in the cup 2.

Although in the above specific description the recess 16 and ledge 14 of the cup 2 extend circumferentially therearound, it will be appreciated that in an alternative embodiment the recess 16 is replaced by a plurality of depressions (not shown) arranged at predetermined positions around the inner surface 12 of the cup 2 to receive the ends of the protuberances 17. For example, in an alternative embodiment two diametrically opposing circular depressions (not shown) are formed in the cup inner surface 12 to receive the two diametrically opposing protuberances 17 extending from the insert 3. Similarly, in an alternative embodiment the circumferentially extending ledge 14 is replaced by two diametrically opposing shelf portions (not shown) projecting from the inner surface 12.

Although in the above description the insert 3 is circular, it will be understood that the insert is not limited thereto and that insert 3 may be any suitable shape.

Although in the present embodiment the insert 3 is removable from the cup 2, it will be appreciated that in an alternative embodiment the insert is fixedly mounted in the cup such that the insert is rotatable therein about the axis defined by the diametrically opposing protuberances.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claims in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. An insert to limit a rate of flow of liquid from a cup, the insert comprising:

a first extended rim extending circumferentially around the insert in a first direction, wherein the first extended rim comprises a first inner surface that forms a first angle greater than 90° with a plate of the insert;

a second extended rim extending circumferentially around the insert in a second direction different from the first direction, wherein the second extended rim comprises a second inner surface that forms a second angle greater than 90° with the plate of the insert; and a mount configured to locate the insert within the cup above the liquid contained therein but below a brim of the cup so that the first and the second extended rims of the insert are spaced predetermined distances from an inner surface of the cup such that, when a person drinks from the brim of the cup fitted with the insert, the rate of flow of liquid to the brim is limited by the insert, wherein the mount comprises a plurality of protuberances extending from a recess formed between the first extended rim and the second extended rim, and wherein the insert disposed in the cup is configured to be rotatable 180 degrees about a rotational axis parallel to the plate between a first orientation and a second orientation.

2. The insert according to claim 1, wherein when the insert is located in the cup in the first orientation, the first extended rim of the insert is spaced a first predetermined distance from the inner surface of the cup such that the rate of flow of liquid to the brim is a first flow rate and, when the insert is disposed in the cup in the second orientation, the second extended rim of the insert is spaced a second predetermined distance from the inner surface of the cup such that the rate of flow of liquid to the brim is a second flow rate.

3. The insert according to claim 2, wherein a radius of the first extended rim is smaller than a radius of the second extended rim such that, when the insert is in the second orientation, the second predetermined distance from the second extended rim to the inner surface of the cup is smaller than the first predetermined distance from the first extended rim to the inner surface of the cup when the insert is in the first orientation.

4. The insert according to claim 1, wherein the plurality of protuberances comprise two diametrically opposing protuberances which are configured to pivotably mount to the inner surface of the cup and define the rotational axis about which the insert is pivotable between the first and the second orientations.

5. The insert according to claim 4, further comprising a locating portion extending from the insert which is configured to locate against a locating ridge formed on the inner surface of the cup to restrict rotation of the insert about the rotational axis when the insert is disposed in the cup.

6. The insert according to claim 5, wherein the locating portion extends from one of the first or the second extended rims.

7. The insert according to claim 2, further comprising a locating portion extending from the first extended rim to locate the insert in the first orientation when the insert is disposed in the cup and a locating portion extending from the second extended rim to locate the insert in the second orientation when the insert is disposed in the cup.

8. An insert to limit a rate of flow of liquid from a cup, the insert comprising:

a first peripheral edge extending circumferentially around the insert in a first direction;

a second peripheral edge extending circumferentially around the insert in a second direction different from the first direction;

a mount configured to locate the insert within the cup above the liquid contained therein but below a brim of the cup so that the first and second peripheral edges of the insert are spaced predetermined distances from an inner surface of the cup such that, when a person drinks from the brim of the cup fitted with the insert, the rate of flow of liquid to the brim is limited by the insert; and two diametrically opposing locating portions extending from the first peripheral edge and two diametrically opposing locating portions extending from the second peripheral edge, wherein the mount comprises a plurality of protuberances extending from a recess between the first peripheral edge and the second peripheral edge, wherein when the insert is located in the cup in a first orientation, the first peripheral edge of the insert is spaced a first predetermined distance from the inner surface of the cup such that the rate of flow of liquid to the brim is a first flow rate and, when the insert is disposed in the cup in a second orientation, the second peripheral edge of the insert is spaced a second predetermined distance from the inner surface of the cup such that the rate of flow of liquid to the brim is a second flow rate.

9. The insert according to claim 1, wherein the plate comprises two opposing faces from which the first and the second extended rims extend, and wherein the insert further comprises a drainage hole formed through the plate which extends between said two opposing faces.

10. A drinking beaker comprising a cup and an insert, the insert comprising:

a first extended rim extending circumferentially around the insert in a first direction, wherein the first extended rim comprises a first inner surface that forms a first angle greater than 90° with a plate of the insert;

a second extended rim extending circumferentially around the insert in a second direction different from the first direction, wherein the second extended rim comprises a second inner surface that forms a second angle greater than 90° with the plate of the insert; and a mount configured to locate the insert within the cup above a liquid contained therein but below a brim of the cup so that at least one of the first extended rim and the second extended rim of the insert is spaced a predetermined distance from an inner surface of the cup such that, when a person drinks from the brim of the cup fitted with the insert, a rate of flow of liquid to the brim is limited by the insert, wherein the mount comprises a plurality of protuberances extending from a recess formed between the first extended rim and the second extended rim, and wherein the insert disposed in the cup is configured to be rotatable 180 degrees about a rotational axis parallel to the plate between a first orientation and a second orientation.

11. The drinking beaker according to claim 10, wherein the inner surface of the cup has a circumferentially extending recess which is configured to receive the plurality of protuberances to mount the insert in the cup.

12. The drinking beaker according to claim 10, wherein the cup further comprises a circumferentially extending locating ridge against which a locating portion of the insert is locatable to restrict rotation of the insert about the rotational axis in the cup.

13. The drinking beaker according to claim 10, wherein the insert is removable from the cup.

14. The insert of claim 1, wherein the predetermined distances surrounding the insert between the first and the second extended rims of the insert and the inner surface of the cup are uniform to allow for uniform rate of flow of liquid from substantially anywhere along the brim of the cup for drinking from the cup anywhere along the brim.

15. The drinking beaker of claim 10, wherein the predetermined distance between the at least one of the first and second extended rims of the insert and the inner surface of the cup is uniform around the entire insert to allow for uniform rate of flow of liquid from substantially anywhere along the brim of the cup for drinking from the cup anywhere along the brim.

16. The drinking beaker of claim 10, wherein the plate of the insert comprises two opposing faces from which the first and the second extended rims extend.

17. The drinking beaker of claim 10, wherein the plurality of protuberances comprise two diametrically opposing protuberances which are configured to pivotably mount to the inner surface of the cup and define the rotational axis about which the insert is pivotable between the first and the second orientations.

* * * * *